US009574573B2

(12) United States Patent
Roth et al.

(10) Patent No.: US 9,574,573 B2
(45) Date of Patent: Feb. 21, 2017

(54) WEAR RESISTANT SLURRY PUMP PARTS PRODUCED USING HOT ISOSTATIC PRESSING

(71) Applicant: SYNCRUDE CANADA LTD. in trust for the owners of the Syncrude Project, Fort McMurray (CA)

(72) Inventors: Hugh Roth, Edmonton (CA); Khaled Obaia, Edmonton (CA); Damien Reid, Edmonton (CA); John Tieu, Fort McMurray (CA); Daniel MacNeil, Fort McMurray (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 689 days.

(21) Appl. No.: 14/072,591

(22) Filed: Nov. 5, 2013

(65) Prior Publication Data

US 2014/0133996 A1 May 15, 2014

Related U.S. Application Data

(60) Provisional application No. 61/723,231, filed on Nov. 6, 2012.

(51) Int. Cl.

| | |
|---|---|
| ***F01D 5/14*** | (2006.01) |
| ***F04D 29/02*** | (2006.01) |
| ***F04D 29/22*** | (2006.01) |

(52) U.S. Cl.

CPC ..... *F04D 29/026* (2013.01); *F04D 29/2294* (2013.01); *F05D 2230/42* (2013.01); *F05D 2300/171* (2013.01); *F05D 2300/2263* (2013.01); *F05D 2300/6032* (2013.01); *Y10T 29/49243* (2015.01)

(58) Field of Classification Search

CPC ..... F04D 29/026; F04D 29/2294; F05D 2300/171; F05D 2300/2263; F05D 2300/6032; F05D 2230/42

See application file for complete search history.

(56) References Cited

U.S. PATENT DOCUMENTS 3,902,823 A * 9/1975 Minato ..... C22C 38/48 416/186 R
4,441,857 A * 4/1984 Jackson ..... F04D 29/289 415/206

(Continued)

FOREIGN PATENT DOCUMENTS

| | | |
|---|---|---|
| CA | 2007687 | 7/1990 |
| CA | 2797164 C | 10/2010 |
| CA | 2784614 A1 | 6/2011 |

*Primary Examiner* — Igor Kershteyn
(74) *Attorney, Agent, or Firm* — Bennett Jones LLP

(57) ABSTRACT

In one aspect, a method for manufacturing a part for a centrifugal slurry pump is provided, comprising: forming a skeleton of the part having an outer dimension smaller than the part; placing the skeleton of the part in a metal enclosure having an interior dimension larger than the outer dimension of the skeleton of the part and thereby forming a space; adding a metal matrix composite powder into the metal enclosure to fill the space; and subjecting the metal enclosure to hot isostatic pressing, thereby allowing bonding of the metal matrix composite to the skeleton of the part to form the part.

8 Claims, 4 Drawing Sheets

(56) References Cited

U.S. PATENT DOCUMENTS

| | | | | |
|---|---|---|---|---|
| 4,529,452 | A * | 7/1985 | Walker | B21J 1/00 148/527 |
| 7,316,057 | B2 * | 1/2008 | Seth | B21K 1/36 29/458 |
| 7,458,765 | B2 * | 12/2008 | Stiles | B23K 26/1476 415/1 |
| 7,981,530 | B2 * | 7/2011 | Sporer | C04B 35/48 416/241 B |
| 2007/0272350 | A1 * | 11/2007 | Voice | B23K 20/021 156/272.8 |
| 2009/0110556 | A1 * | 4/2009 | Jahnz | B22F 3/15 416/179 |
| 2011/0286855 | A1 * | 11/2011 | Cappuccini | B22F 3/15 416/241 R |

* cited by examiner

WEAR RESISTANT SLURRY PUMP PARTS PRODUCED USING HOT ISOSTATIC PRESSING

FIELD OF THE INVENTION

The present invention relates to wear resistant parts for a centrifugal slurry pump. In particular, slurry pump part skeletons for slurry pump parts, for example, impellers and sideliners, which can be made from stainless steel, carbon steel, chromium white iron, etc., are clad with a metal matrix composite by using hot isostatic pressing.

BACKGROUND OF THE INVENTION

A conventional centrifugal slurry pump generally includes an impeller having multiple vanes and which is mounted for rotation within a volute casing. The slurry pump imparts energy to the slurry through the centrifugal force produced by rotation of the impeller. The slurry enters into the impeller through an intake conduit positioned in line with the rotating axis and is accelerated by the impeller, flowing radially outward into the volute casing and subsequently exiting through a discharge conduit. A suction sideliner is positioned a predetermined short distance away from the impeller suction side, the distance being so small as to substantially preclude slurry flow between the impeller and the suction sideliner.

Slurries are two-phase mixtures of solid particles and fluids in which the two phases do not chemically react with each other and can be separated by mechanical means. Slurries are typically characterized as either non-settling or settling in accordance with the size of the solid particles suspended within the fluid. Non-settling slurries include fine particles (less than 50 μm) which form stable homogeneous mixtures. Settling slurries include coarse particles (greater than 50 μm) which form an unstable heterogeneous mixture. Examples of slurries include oil/water; tailings/water; and coke/water slurries. Such slurries can cause abrasion, erosion, and corrosion, resulting in significant wear to pump parts.

Attempts have been made to reduce wear of the pump parts, particularly, the impeller, volute casing, and suction sideliner. A slurry pump operating at low speeds outlasts a faster running pump. Slower running pumps generally have heavier, larger diameter impellers to spread the energy which causes the wear over a larger area. Various modifications related to the configuration, thickness, number, and arrangement of impeller vanes have been described. For example, thicker impeller vanes are capable of handling an abrasive slurry and minimizing wear, but necessitate a reduction in vane number to avoid narrowing the passageways through which the slurry flows.

Pump parts have been formed of various hard metals, elastomeric, or metal-reinforced elastomeric materials to suit the material being pumped. Rubber-lined pumps are often used for pumping non-settling slurries since the resilience of the rubber can absorb and return the energy generated by the impact of the particles to the slurry; however, rubber-lined pumps can be damaged by sharp, large particles or degraded by hydrocarbons. Metal slurry pumps are suitable for pumping abrasive, settling slurries, with 28% chrome iron being the most common material and stainless steel being used for corrosive slurries. The performance of a chrome impeller may be enhanced by laser cladding which deposits an alloy coating to the surfaces of the impeller.

Among all pump parts, the impeller greatly influences the flow patterns of the slurry and the rate of wear. The average lifespan of an impeller is about 1,500 to 2,000 hours, which approximates only half the lifespan of the slurry pump itself. Thus, increasing the lifespan of the impeller would be greatly beneficial in maintaining pump performance and meeting production targets. During manufacture, an impeller is typically cast as one piece, for example, as a high chrome white iron casting. However, chrome white iron (CWI) has only moderately high wear resistance and there is a limited ability to incorporate more wear resisting materials.

Accordingly, there is a need for improved parts such as suction liners and impeller for a centrifugal slurry pump.

SUMMARY OF THE INVENTION

The current application is directed to improved parts for a centrifugal slurry pump. It was surprisingly discovered that by using hot isostatic pressing to clad a part of a centrifugal slurry pump, such as an impeller or sideliner, the life span of a centrifugal slurry pump can be greatly enhanced.

In one aspect, a method for manufacturing a part for a centrifugal slurry pump is provided, comprising:

- forming a skeleton of the part having an outer dimension smaller than the part;
- placing the skeleton of the part in a metal enclosure having an interior dimension larger than the outer dimension of the skeleton of the part and thereby forming a space;
- adding a metal matrix composite powder into the metal enclosure to fill the space; and
- subjecting the metal enclosure to hot isostatic pressing, thereby allowing bonding of the metal matrix composite to the skeleton of the part to form the part.

In one embodiment, the skeleton of the part is made from carbon steel, stainless steel, or other strong steel. In another embodiment, the metal matrix composite powder comprises a tungsten carbide powder and a nickel alloy powder. In another embodiment, the metal matrix composite powder comprises about 50% tungsten carbide powder and about 50% nickel alloy powder.

In one embodiment, the part is a slurry pump sideliner. In another embodiment, the part is a slurry pump impeller.

By practicing the present invention, all of the elements will be metallurgically bonded, thereby providing a robust component (part) that has improved wear resistance.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor.

The detailed description includes specific details for the purpose of providing a comprehensive understanding of the present invention. However, it will be apparent to those skilled in the art that the present invention may be practiced without these specific details.

Figure 1:
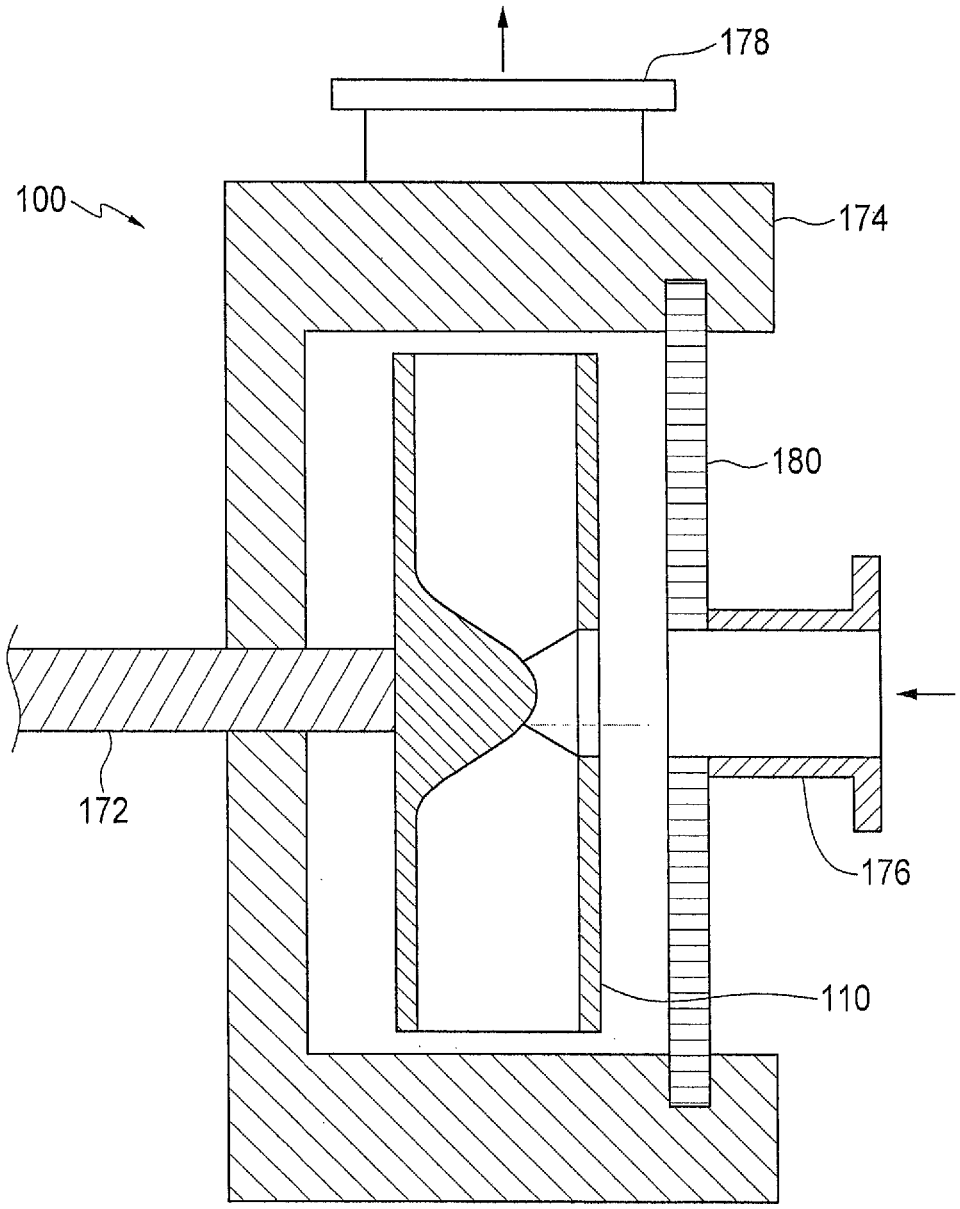
FIG. 1 PRIOR ART
FIG. 1 is a cross-sectional view of a prior art embodiment of a centrifugal slurry pump.

The present invention relates generally to a method for manufacturing parts for use in a centrifugal slurry pump. An embodiment of a prior art centrifugal slurry pump 100 is shown in cross-section in FIG. 1. The centrifugal pump 100 is driven by a motor (not shown), such as electric motor, turbine, etc., that is connected to an impeller 110. Impeller 110 is provided in a volute casing 174. An intake conduit 176 is provided in the volute casing 174 to route liquid into the pump 100, where the liquid will be subsequently discharged from the pump 100 through a discharge conduit 178 provided in the volute casing 174. A suction sideliner 180 is provided to allow access to the inside of the volute casing 174. Rotation of the impeller 110 causes slurry within the volute casing 174 to be accelerated radially from the intake conduit 176 and discharged circumferentially at increased pressure at pump outlet, discharge conduit 178, in a manner well understood by those skilled in the art.

The present invention uses hot isostatic pressing or HIP to clad parts of a slurry pump to improve the life span of the slurry pump. The two parts that show the greatest wear are the impeller and the suction sideliner. Thus, the present invention is particularly useful in the manufacturing of impellers and sideliners.

HIP involves the simultaneous application of high pressure (15,000 to 45,000 psi) and elevated temperatures (up to 2500° C.) in a specially constructed vessel. The pressure is usually applied with an inert gas such as argon, and so is "isostatic". Under these conditions of heat and pressure internal pores or defects within a solid metal body collapse and diffusion bonding occurs at the interfaces. Encapsulated powder and sintered components can also be fully densified to give improved mechanical properties.

In the present invention, skeletons of various parts are manufactured by processes known in the art, generally, being casts of carbon steel, stainless steel, or other strong steel. The term "skeleton" as used herein means a slurry pump part, such as an impeller, suction sideliner, etc., that has smaller dimensions than the part that will be eventually used in the slurry pump. For example, in one embodiment, it may desirable to only strengthen the top portion of a part. In this instance the width of the skeleton may be the same as the usable part but the height may be less so that the top surface of the impeller can be strengthened by cladding using HIP.

The skeleton is placed into a metal container, or can, which is generally made from a high quality steel and which must be strong enough to maintain shape and dimensional control but be soft and malleable at the HIP temperature. A standard container, or can, is generally between about 2 and 3 mm thick. The metal container is sized to fit around the skeleton but also provides a space which represents the portion of the part to be clad by HIP. In one embodiment, the can is welded to the part.

The space in the metal container is generally filled with a powder or combination of powders that are converted by HIP into fully dense layers that clad the desired portion of the skeleton part. Examples of powders useful in the present invention are powdered metal matrix composites which are composite materials with at least two constituent parts, one being a metal. In one embodiment, the metal matrix powder is a combination of tungsten carbide and a nickel alloy, for example, a powder comprising about 50% tungsten carbide ceramic and about 50% nickel alloy.

Figure 2:
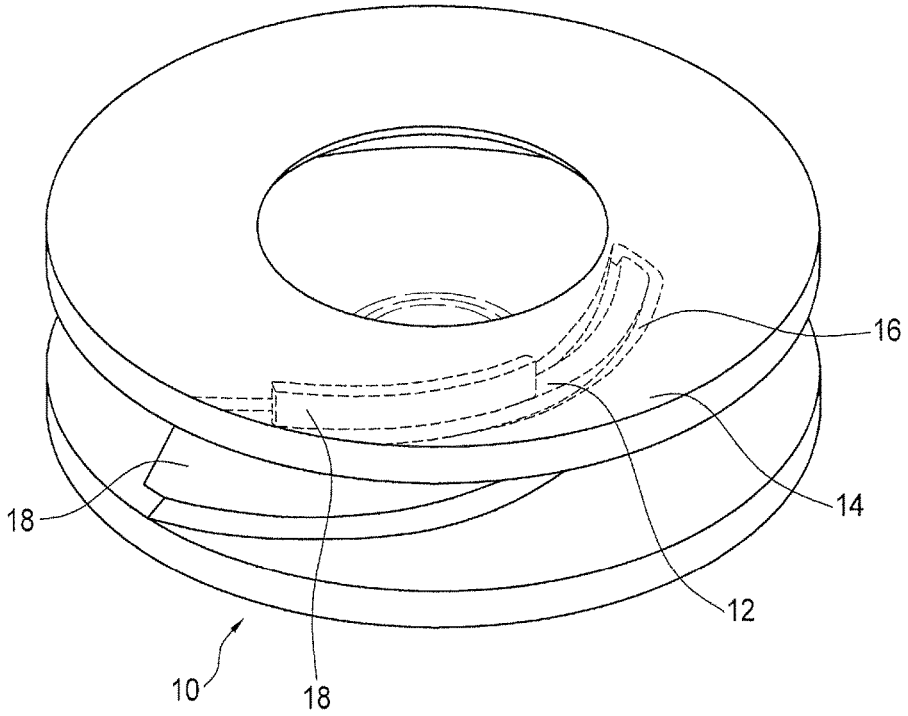
FIG. 2 is a perspective view of an impeller skeleton and a metal container useful in forming a wear resistant impeller using the method of the present invention.
Figure 3:
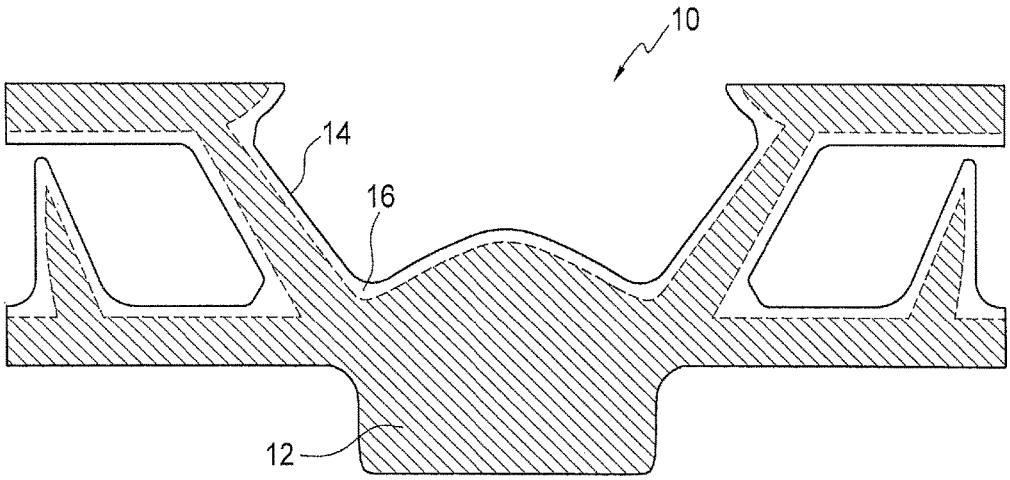
FIG. 3 is a cutaway cross-sectional view of FIG. 2.

FIG. 2 shows an impeller 10 which can be made according to the present invention. Prior art impellers are generally manufactured as a single piece and are made from chrome white iron (CWI). However, in the present invention, impeller skeleton 12 is made from carbon steel or stainless steel, because CWI is not amenable to HIP as CWI may shatter during the HIP process. As can be seen more clearly in FIG. 3, impeller skeleton 12 is smaller than the final impeller product of the present invention. Impeller skeleton 12 is encased in a metal container 14, which has internal dimensions that are larger that the external dimensions of the impeller skeleton 12, thereby forming a space 16. A metal matrix composite powder is poured into the space and the metal container is sealed, pre-heated and then subjected to hot isostatic pressing in a pressure vessel. In the case of powder metallurgy (PM) super alloys, i.e., nickel-base powder metallurgy (PM) superalloys, typical HIP conditions are a temperature of between 1100 and 1260° C. and a pressure of 100 to 200 MPa, which is maintained for several hours with argon as the pressurizing medium. Thus, the impeller now has a surface comprising, for example, a tungsten carbide/nickel alloy blend, which is much stronger and can withstand much more wear from slurries than CWI impellers. Furthermore, HIP results in no seam formation, joints, gaps, etc.

In one embodiment, the impeller skeleton 12 may further comprise a leading edge 18, which edge 18 is made of a wear resistant material such as tungsten carbide MMC or cemented tungsten carbide. This would provide additional wear resistance.

Figure 4A:
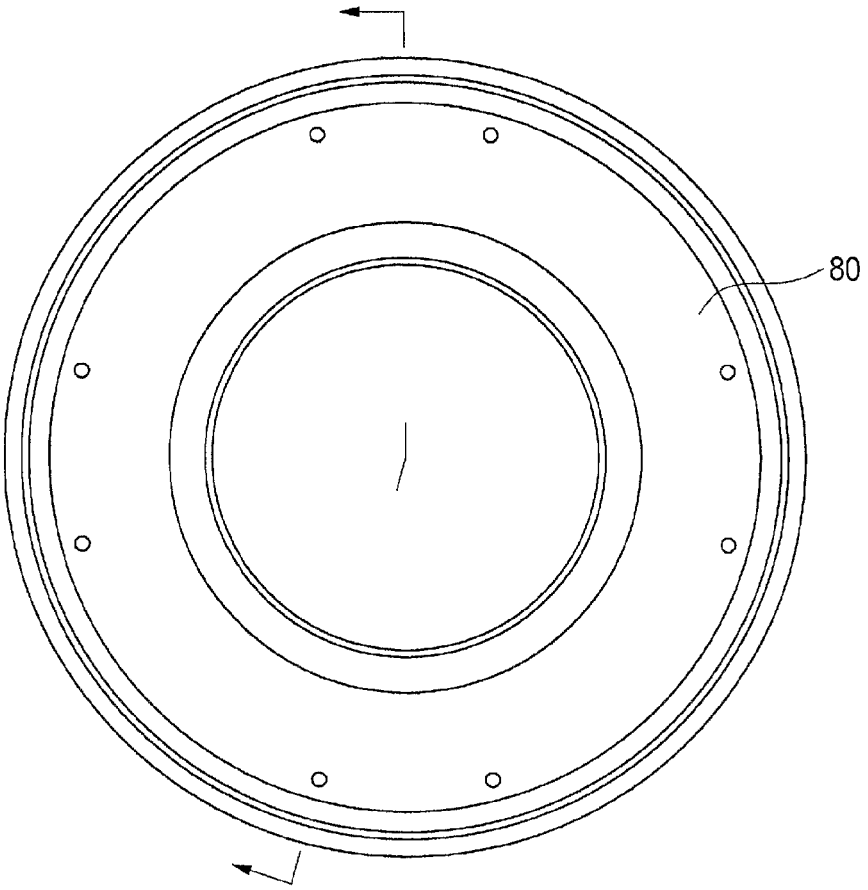
FIG. 4A is a top view of a suction liner fabricated using the method of the present invention.
Figure 4B:
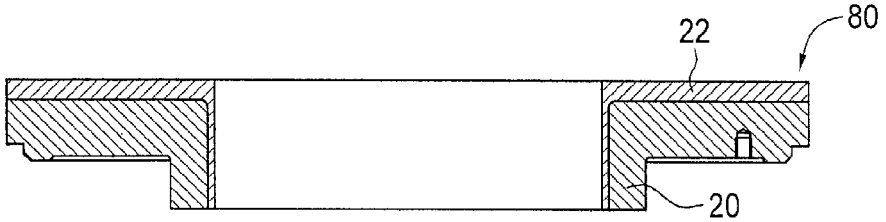
FIG. 4B is a cutaway cross-sectional view of FIG. 4A.

FIG. 4A shows a suction sideliner 80 manufactured by the present invention. As it can be seen in FIG. 4A, a sideliner is generally shaped like a washer and in this instance, a container can be welded above a skeleton sideliner defining a space for a metal matrix composite powder to fill. FIG. 4B shows a cross-section of suction sideliner 80, which shows that the sideliner comprises skeleton 20, which may be made from carbon steel, stainless steel, and the like, having a cladding or layer 22 formed by HIP made of tungsten carbide-containing nickel alloy.

The scope of the claims should not be limited by the preferred embodiments set forth in the examples, but should be given the broadest interpretation consistent with the description as a whole.

We claim:

1. A method for manufacturing a part for a centrifugal slurry pump, comprising:

forming a skeleton of the part having an outer dimension smaller than the part;

placing the skeleton of the part in a metal enclosure having an interior dimension larger than the outer dimension of the skeleton of the part and thereby forming a space;

adding a metal matrix composite powder into the metal enclosure to fill the space; and subjecting the metal enclosure to hot isostatic pressing, thereby allowing bonding of the metal matrix composite to the skeleton of the part to form the part.

2. The method of claim 1, wherein the skeleton of the part is made from carbon steel, stainless steel, or other strong steel.

3. The method of claim 1, wherein the metal matrix composite powder comprises a tungsten carbide powder and a nickel alloy powder.

4. The method of claim 3, wherein the metal matrix composite powder comprises about 50% tungsten carbide powder and about 50% nickel alloy powder.

5. The method of claim 1, wherein the part is a slurry pump sideliner.

6. The method of claim 1, wherein the part is a slurry pump impeller.

7. The method of claim 6, wherein the skeleton of the impeller comprises a leading edge made of wear resistant material.

8. The method of claim 7, wherein the leading edge is made from tungsten carbide MMC or cemented carbide.

* * * * *